US012522405B2

(12) United States Patent
Liow

(10) Patent No.: US 12,522,405 B2
(45) Date of Patent: Jan. 13, 2026

(54) CLOSURE DEVICE AND METHOD FOR PRESERVING OXIDIZABLE PRODUCTS

(71) Applicant: NOVEL PATENT SERVICES, Houston, TX (US)

(72) Inventor: Chang Chyan Liow, Windsor, CA (US)

(73) Assignee: Chang Chyan Liow, Windsor, CA (US)

( * ) Notice: Subject to any disclaimer, the term of this patent is extended or adjusted under 35 U.S.C. 154(b) by 0 days.

(21) Appl. No.: 18/664,160

(22) Filed: May 14, 2024

(65) Prior Publication Data

US 2024/0409276 A1 Dec. 12, 2024

Related U.S. Application Data

(63) Continuation-in-part of application No. 18/525,037, filed on Nov. 30, 2023.

(51) Int. Cl.

| | |
|---|---|
| ***B65D 39/04*** | (2006.01) |
| ***B65D 51/24*** | (2006.01) |
| ***B65D 51/28*** | (2006.01) |
| ***B65D 81/24*** | (2006.01) |

(52) U.S. Cl.

CPC ..... *B65D 39/04* (2013.01); *B65D 51/244* (2013.01); *B65D 51/28* (2013.01); *B65D 81/245* (2013.01)

(58) Field of Classification Search

CPC ..... B65D 51/2857; B65D 51/285; B65D 51/002; B65D 51/22; B65D 51/222; B65D 51/226; B65D 39/04; B65D 51/244; B65D 51/28; B65D 81/245; B65D 51/2835; B65D 81/2076; B65D 41/20

See application file for complete search history.

(56) References Cited

U.S. PATENT DOCUMENTS

| | | | | |
|---|---|---|---|---|
| 2,275,567 A * | 3/1942 | Smith | B65D 51/2871 | 604/416 |
| 4,756,436 A * | 7/1988 | Morita | B65D 51/244 | 426/124 |
| 8,205,541 B2 * | 6/2012 | Barberio | B67D 3/0051 | 99/323.1 |
| 8,215,481 B1 * | 7/2012 | Knickerbocker | B65D 51/285 | 215/DIG. 8 |
| 8,701,906 B1 * | 4/2014 | Anderson | B65D 41/20 | 215/DIG. 8 |

(Continued)

*Primary Examiner* — Kareen K Thomas

(74) *Attorney, Agent, or Firm* — Novel Patent Services

(57) ABSTRACT

A closure device for a container to provide a combined protection of inert gas and oxygen scavenger methods. The closure device comprises a body, a fastening member, one or more plurality of protrusions, a blister, a hollow shaft, and a seal member. The closure device is removably coupled to an open end of the container through a fastening assembly. The fastening assembly includes at least one of friction fit, a snap fit, a screw fit, or any of a variety of fastening mechanisms. The closure device provides a combined protection of inert gas and oxygen scavenger methods. This is beneficial because it prevents nutritional and organoleptic degradation processes of wine through oxidation while aids to preserve the fruitier and fresher aromas and flavors of the wine. The closure device is designed to fit snugly over the neck of the bottle and create an airtight seal.

23 Claims, 14 Drawing Sheets

(56) References Cited

U.S. PATENT DOCUMENTS

| | | | | |
|---|---|---|---|---|
| 9,567,200 | B2 * | 2/2017 | Eriksson | B67D 1/0845 |
| 10,220,991 | B2 * | 3/2019 | Lutz | B65D 39/0076 |
| 10,266,322 | B2 * | 4/2019 | Hauck | B65D 51/2857 |
| 11,198,547 | B2 * | 12/2021 | Maguire | B65D 51/2892 |
| 11,220,381 | B2 * | 1/2022 | Weinberg | B65D 39/16 |
| 2002/0096440 | A1 * | 7/2002 | Kasuya | B65D 25/08 206/222 |
| 2009/0236303 | A1 * | 9/2009 | Lizerbram | B65D 51/2821 206/219 |
| 2010/0100117 | A1 * | 4/2010 | Brister | A61L 31/088 606/192 |
| 2015/0217912 | A1 * | 8/2015 | Luzaich | B65D 51/244 220/254.1 |
| 2015/0217914 | A1 * | 8/2015 | Burgess | B65D 51/2857 220/521 |

* cited by examiner

CLOSURE DEVICE AND METHOD FOR PRESERVING OXIDIZABLE PRODUCTS

The present disclosure relates generally to storage devices and methods for oxygen-sensitive substances, and more particularly to a closure device that provides a double protection for persevering any oxygen-sensitive substance without developing any undesirable odors and flavor profiles.

BACKGROUND

Oxidation can have significant effects on products such as food and beverages, leading to changes in effectiveness, flavor, color, aroma, and overall quality and reduces its shelf life. However, exposure to oxygen can be detrimental for certain foods and beverages. A study demonstrated a rapid decline in the concentration of 3-mercaptohexanol, a compound responsible for tropical and fruity aromas in Sauvignon blanc wines sealed under closures and stored in oxygen-rich environments.

When these products exposed to the atmospheric conditions can cause the products to lose their effectiveness or develop an unpleasant or different taste. For example, once a bottle of aromatic alcoholic beverages such as wines, gins and sake is opened, the alcoholic beverages doesn't last long. Once opened, the shelf life of the alcoholic beverages could be decreased due to atmospheric exposure, which can result in an undesired taste. In general, wine exposed to oxygen loses its original flavor and quality due to degradation. Oxygen triggers chemical reactions and bacterial growth, leading to wine degradation.

Conventional ways to store oxygen-sensitive substances like wine include using corks or stoppers, vacuum preservation, and air displacement. For users who intend to open a bottle of wine and not consume the entire bottle, there are a handful of methods commercially available to extend the opened shelf life of the wine. These can be classified into two general categories: vacuum preservation and "air displacement".

Vacuum preservation methods involve partially removing oxygen from a container to prevent degradation or oxidation and quality of food and other products, such as wine fresh fruits and vegetables. This process creates a partial vacuum that helps to extend the shelf life of food and other products, but it can also alter the taste and texture of some foods. At present there are apparatuses that are used for vacuum preservation such as hand pump vacuum sealers and industrial vacuum sealers for food packaging.

However, the hand pump vacuum sealers are less powerful than the industrial vacuum sealers and therefore can only create a partial vacuum. They can remove air from containers but some oxygen will still be present, which limits the shelf life of foods stored in this way to only for three days. Further, the hand pump vacuum sealers can remove volatile aromatics from food, affecting its taste and smell. This makes hand pump vacuum sealers unsuitable for sealing strongly flavored items like coffee or spices or wine.

Furthermore, the industrial vacuum sealers are a powerful tool that can extend the shelf life of food. However, they are expensive, complex, and not suitable for all products as it can alter the taste and texture of some foods. For example, they are not recommended for vacuum sealing fresh fruits and vegetables that emit ethylene gas, as this gas can cause the fruits and vegetables to ripen prematurely.

Air displacement methods replace the air in the headspace of an opened bottle of wine with an inert gas to prevent oxidation. This is more effective than vacuum preservation, but it is also more expensive and difficult to use.

Oxygen scavengers are employed to remove the presence of oxygen from a wine container. Oxygen scavengers are very effective and will start to react to oxygen immediately upon exposing them to air. However, even after the implementation of an oxygen scavenger preservation method, oxidation-sensitive substances such as wine remains susceptible to oxidation. The oxygen scavengers only become effective after 8 to 72 hours depending on the ambient temperature and composition of the oxygen scavengers, causing a noticeable delay. During this period, the wine remains exposed to oxidation until the oxygen scavenger has fully eliminated the oxygen from the headspace.

Further, even though the oxygen scavengers immediately start to react to oxygen, they can produce unpleasant odors in the wine container. For example, ferrous oxygen scavengers, commonly known as iron powder, offer rapid oxygen removal but can impart undesirable metallic or "rusty" aromas and flavors and rendering the wine "reductive". Additionally, the oxygen scavengers also remove volatile aromas of the wine due to negative pressure caused by the absorption of oxygen.

Both vacuum preservation and air displacement methods can extend the shelf life of opened wine, however, they both have drawbacks. Vacuum preservation can alter the taste of the wine, while air displacement is more expensive and difficult to use. The existing methods for extending the opened shelf life of food, or liquid, or wine are expensive, less convenient, and less effective. Further, the existing methods fail to prevent the food or liquid from developing an undesirable flavor profile. The existing methods are difficult to clean, have risk of cross-contamination, and are expensive. Further, the existing closure device doesn't provide combined protection of inert gas and oxygen scavenger methods.

A prior art U.S. Pat. No. 11,760,546B2 describes a de-oxygenation stopper that is designed to minimize oxygen content in a vessel, allowing wine and other oxygen-sensitive materials to age properly. It has an oxygen scavenging element that removes oxygen molecules and a sealing element that controls oxygen transmission at a desired rate. This can be helpful for preserving foods and beverages that are sensitive to oxygen, such as wine and olive oil. However, the de-oxygenation stopper is not suitable for all types of containers. For example, it cannot be used with containers that have a very narrow neck or that are made of a material that is not compatible with the stopper. In addition, the de-oxygenation stopper controls the oxygen transmission at a desired rate and does not provide a protective layer over the oxidation-sensitive substances. This means any remaining oxygen can still oxidize and degrade the food or beverage. This method often has ferrous oxygen scavengers, commonly known as iron powder, offer rapid oxygen removal but can impart undesirable metallic or "rusty" aromas and flavors, rendering the wine "reductive". Additionally, the oxygen scavengers also remove volatile aromas of the wine due to negative pressure caused by the absorption of oxygen.

In another prior art US20150069085A1 describes devices and methods for extracting fluids from containers sealed with corks or septums. The devices are used to extract and preserve a fluid such as wine stored in a container. The devices could be fixed to the container and injects compressed air or other gases into the container for extracting the fluid from the container. The compressed air or other gas may act directly or indirectly on the wine in the container.

However, the devices are expensive and can displace vital volatile aromatics of the wine when the inert gases are injected into the container. In addition, holes on a cork created by a needle of the apparatus during installation can cause wine leaks and may allow the oxygen to enter into the container. Further, there's a risk of bottle explosion due to excessive internal pressure. Moreover, the needle and wine displacement may cross-contaminate between multiple bottles if not properly sanitized after each use. Therefore, employing the apparatus to preserve the fluids like wine in the containers is not deemed a reliable or effective method.

In another prior art US20190270560A1 describe systems and methods that utilize an oxygen scavenging agent coupled to a sealing device to remove oxygen from the headspace of a container, effectively preserving oxidizable substances like liquids or foodstuffs. The oxygen scavenging agent removes the oxygen without significantly reducing the pressure in the headspace, preventing adverse effects on the flavor of the substance, such as wine. However, the described systems and methods only uses oxygen scavenging agent to remove oxygen and does not provide any protective layer over the oxidation-sensitive substances. This means any remaining oxygen can still oxidize and degrade the food or beverage. Further, the device is bulky, which can make it difficult to store and use. This method often has ferrous oxygen scavengers, commonly known as iron powder, offer rapid oxygen removal but can impart undesirable metallic or "rusty" aromas and flavors, rendering the wine "reductive". Additionally, the oxygen scavengers also remove volatile aromas of the wine due to negative pressure caused by the absorption of oxygen.

In another prior art U.S. Pat. No. 4,473,174A discloses a device for preserving and dispensing wine from a bottle. The device includes a stopper assembly that is inserted into the neck of the bottle and a removable cap assembly. The cap contains a chamber that houses a pressurized gas cartridge. The stopper assembly has a valve with three positions: off, vent, and pressurize. In the pressurize position, gas from the cartridge is released into the bottle to create an inert atmosphere. In the vent position, excess pressure in the bottle can be released. A second valve in the stopper assembly controls a spout from which wine is dispensed. However, the device is expensive, complex, and not suitable for all products as it can alter the taste and texture of some foods.

Yet another prior art U.S. Pat. No. 4,475,576A discloses a convenient oxygen purging system for bottled wines is provided using a counter-top inert gas bottle housing with a depending contact-operated gas dispensing head. A separate stopper fits into the opened mouth of a wine bottle. The stopper has a valved port system such that when pressed against the inert gas dispensing head, the inert gas is blown inside the wine bottle, expelling the air from the bottle through an evacuation port and replacing the air with the inert gas. However, the device is expensive, bulky and complex. Further, the device doesn't used oxygen scavenging agent to remove oxygen from the wine bottle.

Further, yet another prior art U.S. Pat. No. 10,220,991B2 discloses a system and methods for de-oxygenation of a closed container. The system includes a sealing device that can be attached and sealed to the vessel. The sealing device is comprised of a first end, a second end, and a sidewall extending between them, and includes a channel that passes between the two ends. The system also includes a member or a canister containing an oxygen-scavenging agent, such as a sachet, that extends partially into the channel of the sealing device. When the sealing device is bound to the vessel, the oxygen scavenging agent is in fluidic contact with the headspace of the vessel, enabling it to extract oxygen and protect the oxygen-sensitive substance. However, the existing sealing device may also remove volatile aromas of the wine due to negative pressure caused by the absorption of oxygen. Further, the existing system and methods only utilize the oxygen-scavenging agent to eliminate oxygen from the sealed container, which reduces the efficiency of oxygen removal and cannot completely remove oxygen from the container.

Researchers have conducted several studies on beverage packaging using different materials. One study focused on orange juice packaging and found that orange juice stored in monolayer PET bottles with an oxygen scavenger, liquid nitrogen in the headspace, and an aluminum foil seal in the screw-cap had a shelf life of nine months at 4° C. and nearly eight months at 25° C. This study also indicated that the color stability and shelf life of orange juice could be extended by lowering the storage temperature and preventing oxygen permeation through the packaging.

Therefore, there is a need for a closure device that provides a double protection for persevering any oxygen-sensitive substance without developing any undesirable odors and flavor profiles. There is also a need for a closure device that uses a less aggressive de-oxygenation agent, which results in fruitier and fresher wines without any undesirable odors. There is also a need for a closure device, which is specifically tailored for vessels like wine bottles.

SUMMARY OF THE INVENTION

The following presents a simplified summary of one or more embodiments of the present disclosure to provide a basic understanding of such embodiments. This summary is not an extensive overview of all contemplated embodiments and is intended to neither identify key nor critical elements of all embodiments, nor delineate the scope of any or all embodiments.

The present disclosure, in one or more embodiments, relates to a closure device for a container. In one embodiment herein, the closure device provides a combined protection of inert gas and oxygen scavenger methods. The closure device comprises a body, a fastening member, a plurality of protrusions, a blister, a hollow shaft, and a seal member. The closure device is removably coupled to an open end of the container through a fastening assembly that includes at least one of friction fit, a snap fit, a screw fit, or any of a variety of fastening mechanisms.

In one embodiment, the body defines a channel or a chamber that is configured to store one or more primary gases and at least one absorbent material. In one embodiment, the fastening member is disposed circumferentially on an outer surface of the body. The fastening member is configured to create an airtight seal for the container upon insertion of the closure device. In one embodiment, the fastening member is of a material that includes at least one of plastic, silicone rubber, and any flexible polymers. The fastening member comprises the protrusions that are extended outward radially from a surface of the fastening member. The protrusions are engaged with an interior surface of the container to ensure the airtight seal for the open end of the container.

In one embodiment, the blister is positioned on one end of the body, wherein the blister is connected to a hollow shaft, and the hollow shaft contains at least one secondary gas. In specific, the blister is configured with an indicator unit indicating the presence of oxygen in the container. The indicator unit includes at least one of a display with an oxygen sensor and an oxygen indicator dye to measure oxygen levels present within a headspace of the container.

In one embodiment, the seal member is disposed at a bottom of the body. The seal member is configured to be broken by the hollow shaft through the blister for releasing the primary gases, and the secondary gas from the body and the hollow shaft into the container to form a protective barrier and expose the absorbent material to the headspace of the container. The absorbent material absorbs remaining oxygen from the headspace of the container.

In one embodiment, the body, the blister, and the hollow shaft are made of a material that includes at least one of plastic, silicone rubber, metal, natural cork, and synthetic cork. Further, the body, the blister, and the hollow shaft are made of plastic that includes at least one of polyethylene terephthalate (PET), high-density polyethylene (HDPE), thermoplastic elastomer (TPE), polypropylene (PP), ethylene vinyl alcohol copolymer (EVOH), and polyamide (PA).

In another embodiment, the closure device comprises a replaceable capsule. In one embodiment herein, the replaceable capsule contains the absorbent material, and filled with the inert gases. The blister is firmly attached to an openable cap. The blister is connected with a puncturing member of the hollow shaft. In specific, the absorbent material is enclosed entirely within the replaceable capsule. When the blister is pressed down, the puncturing member punctures the replaceable capsule. This action leads to the release of the inert gases, which creates the protective barrier against oxygen, within the headspace of the container. At the same time, the absorbent material inside the replaceable capsule is exposed, further removing any residual oxygen within the container, ensuring that the contents remain fresh and unaffected by any harmful environmental factors.

The closure device uses inert gases, such as primary and secondary gases, which are heavier than the oxygen, as the density of oxygen is 1.331 kg/m$^3$. The inert gases include at least one of argon gas, which has a density of 1.661 kg/m$^3$, krypton gas, which has a density of 3.74 kg/m$^3$, xenon gas, which has a density of 5.86 kg/m$^3$, radon gas, which has a density of 9.73 kg/m$^3$ and carbon dioxide gas, which has a density of 1.842 kg/m$^3$. In a preferred embodiment, the primary gases comprise argon gas and the secondary gas is carbon dioxide. In one embodiment, the absorbent material that includes at least one of metal-based substance, and non-ferrous absorbent material. In case, the absorbent material is a non-ferrous absorbent material. Then, the non-ferrous absorbent material reacts with the oxygen and absorb within from the container to release carbon dioxide, which functions as the secondary inert gas to form the protective barrier with the primary gases.

An embodiment of the first aspect wherein a method for de-oxygenation of the container by the closure device. In first step, the closure device is inserted into the open end of the container by inserting the body into the open end of the container. Next, the blister is pressed or actuated to push the hollow shaft in a downward direction to penetrate the seal member by the hollow shaft. In one embodiment, the blister is actuated upon detection of oxygen within the container beyond a threshold level.

Next, as the seal member is broken, the primary gases from the body, and the secondary gas from the hollow shaft are released into the headspace of the container to form the protective barrier within the container. Further, the absorbent material is exposed within the headspace for absorbing oxygen from the container.

In one embodiment herein, the closure device comprises a body with an openable head, and an elongated cylindrical portion that is connected to the openable head. The body defines a channel or a chamber that is configured for securing the replaceable capsule. The replaceable capsule is configured for holding the inert gases and the oxygen absorbing agent. The openable head is detachably attached to the body. The blister is configured to be pressed by a user to puncture the replaceable capsule. This releases inert gases to form the protective barrier against oxidation within the container. As a result, the absorbent material inside the container is exposed for absorbing oxygen from the headspace.

In one embodiment, the blister is connected with at least one puncturing member. The puncturing member is configured to puncture the replaceable capsule upon pressing the blister. The puncturing member comprises at least one of a needle or a blade or a sharp edged portion. The openable head is detachably attached to the body through a fit that includes at least one of a friction fit, a snap fit, a screw fit, and a pivotal fit.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

The accompanying drawings, which are incorporated in and constitute a part of the specification, illustrate an embodiment of the invention, and, together with the description, explain the principles of the invention.

DETAILED DESCRIPTION

Figure 1A:
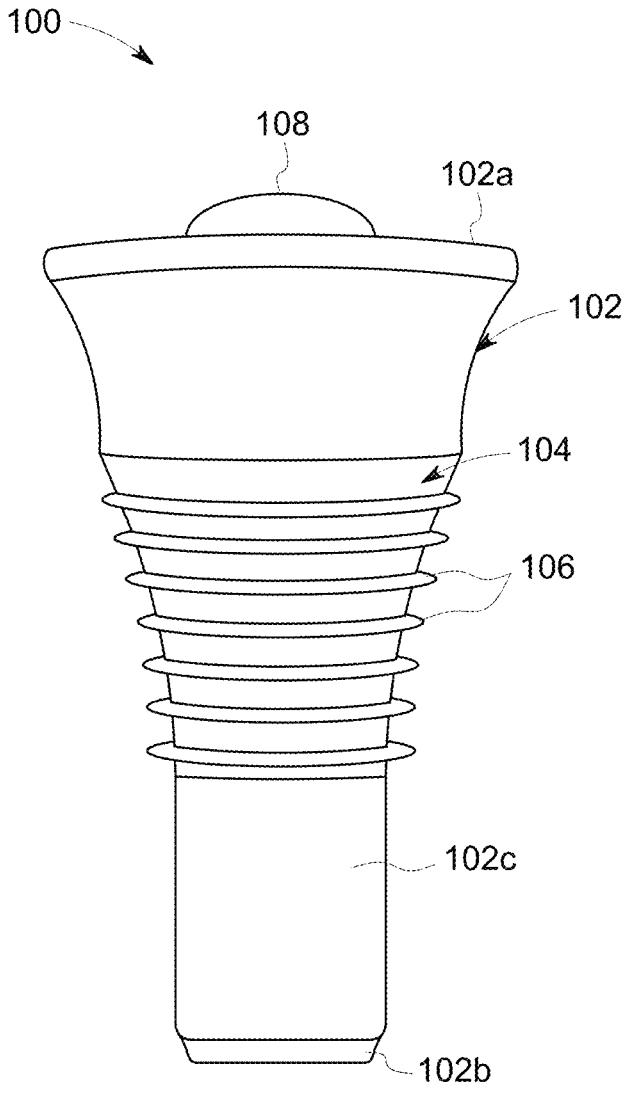
FIG. 1A illustrates a perspective front view of a closure device, in accordance with embodiments of the invention.

Reference will now be made in detail to the present preferred embodiments of the invention, examples of which are illustrated in the accompanying drawings. Wherever possible, the same reference numerals are used in the drawings and the description to refer to the same or like parts.

FIGS. 1A-3 refer to perspective views of a closure device 100 for a container 10. In one embodiment herein, the closure device 100 is configured to provide a combined protection of inert gas and oxygen scavenger methods. The closure device 100 comprises a body 102, a fastening member 104, a plurality of protrusions 106, a blister 108, a hollow shaft 110, a seal member 112, and an openable cap 114. In one embodiment herein, the closure device 100 ensures the airtight seal when disposed on the container 10 to preserve liquids and other items, which degrade when exposed to oxygen for a period of time through a protective barrier and at least one absorbent material against oxidation.

In one embodiment, the container 10 includes, but is not limited to, wine bottles, reusable food storage containers, and other vessels. In another embodiment, the closure device 100 described herein can be applied to any oxygen-sensitive substance for which preservation or storage is desired. For example, wine, foodstuffs, other liquids, pharmaceuticals or drugs, chemicals, paints, adhesives, or any of a variety of materials can be contemplated.

Figure 3:
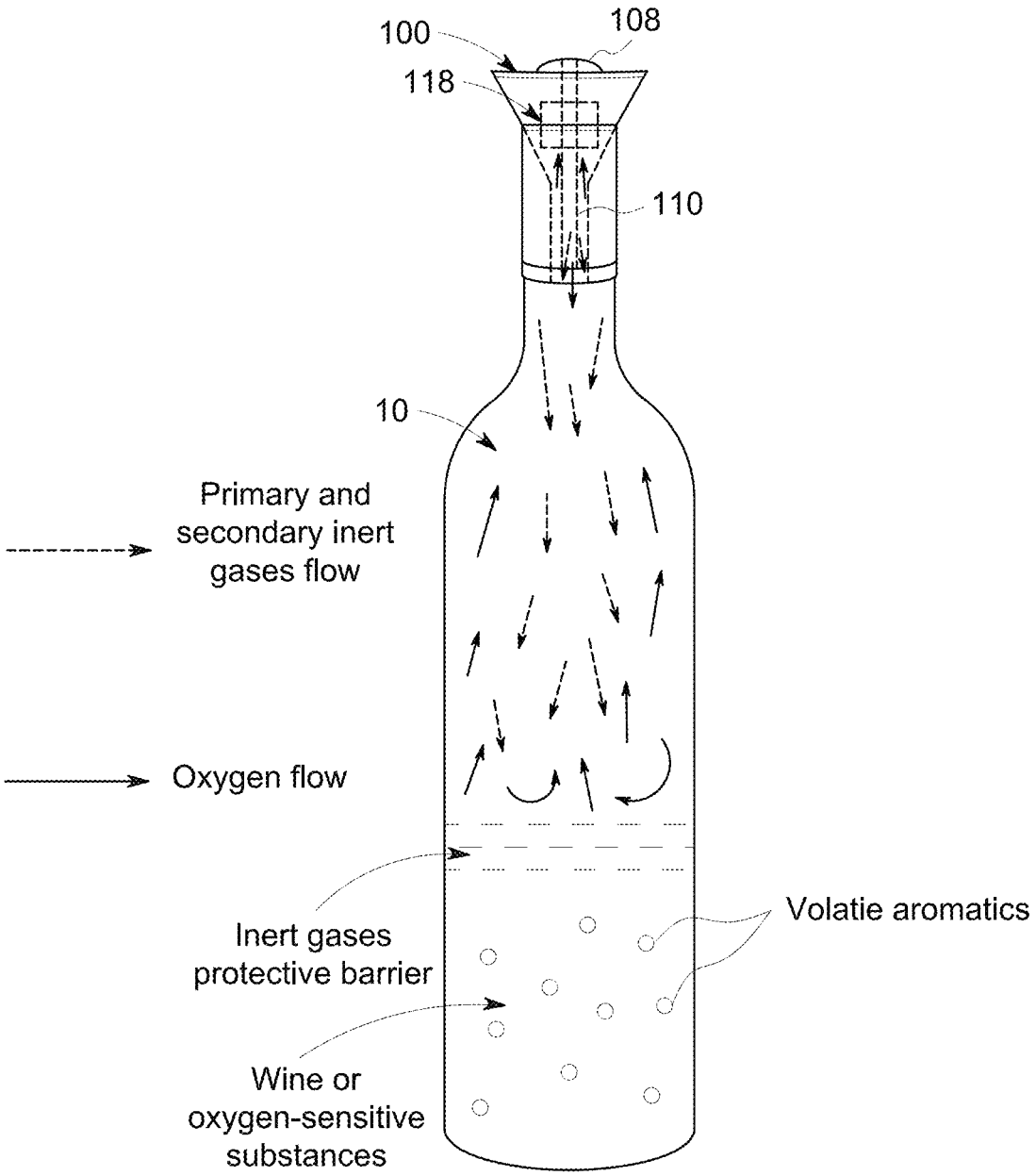
FIG. 3 illustrates a perspective view of the closure device inserted in a container, in accordance with embodiments of the invention.

In one embodiment herein, the closure device 100 is removably coupled to an open end of the container 10 through a fastening assembly, as shown in FIG. 3. The fastening assembly includes at least one of a friction fit, a snap fit, a screw fit, or any of a variety of fastening mechanisms.

In another embodiment, the friction fit is a type of fastening assembly that relies on the friction between two surfaces to hold them together. In the case of the closure device 100, the friction fit could be created between the fastening member 104 and the inside of the open end of the container 10.

In another embodiment, the snap-fit is a type of fastening assembly that uses a series of snaps to hold two surfaces together. In the case of the closure device 100, the snap-fit could be created between the fastening member 104 and the open end of the container 10. The snap-fit could be used to couple the closure device 100 to the open end of a reusable food storage container.

In another embodiment, the screw fit is a type of fastening assembly that uses a screw to hold two surfaces together. In the case of the closure device 100, the screw fit could be created between the fastening member 104 and the open end of the container 10. In some embodiments, the fastening assembly include a bayonet fit, a push-fit, and a magnetic fit.

In some embodiments, the closure device 100 can have a lid, cap, or cover that attaches to the container 10. The lid or cap can be square, rectangular, circular, triangular, or any other shape that matches the cross-sectional shape of the container 10. The lid or cap can be attached to the container 10 by snapping it on, pushing it on, or screwing it on.

In some embodiments, the lid or cap is removably coupled to the container 10 by snap or friction fit or can include threads for threaded engagement with complementary threads formed on the container body.

Figure 1B:
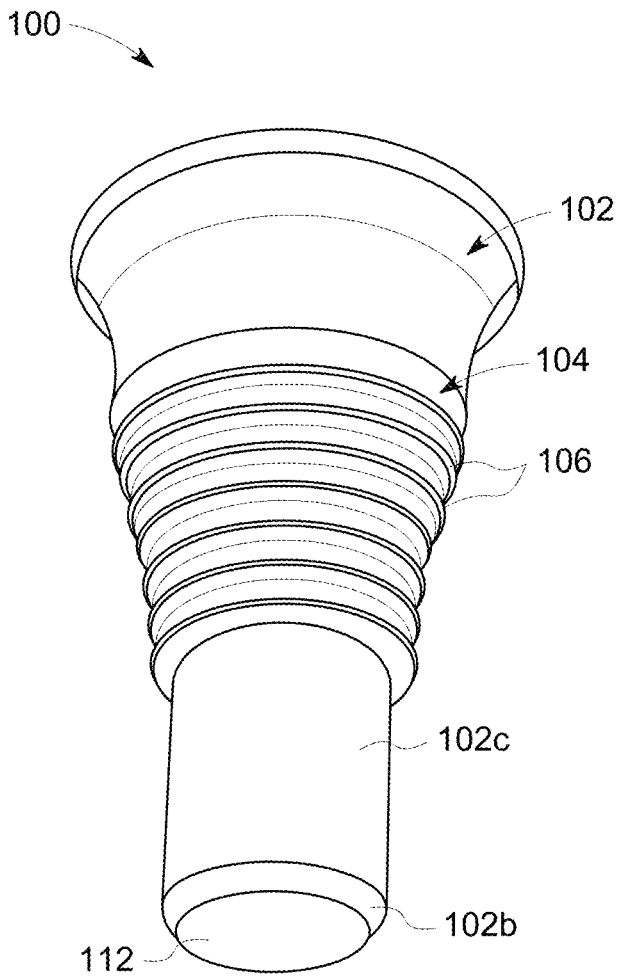
FIG. 1B illustrates a perspective bottom view of the closure device, in accordance with embodiments of the invention.
Figure 1C:
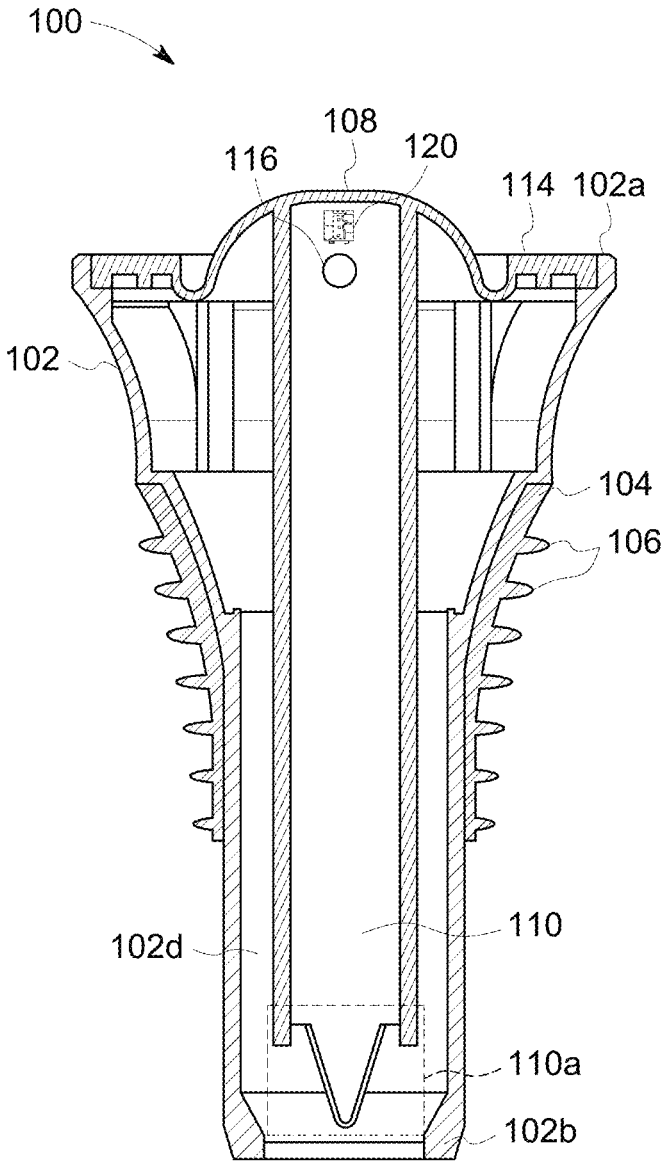
FIG. 1C illustrates a sectional view of the closure device, in accordance with embodiments of the invention.

In one embodiment, the body 102 defines a channel or a chamber 102*d* that is configured to store one or more primary gases and at least one absorbent material. The body 102 is a cylindrical gas chamber that comprises a first end 102*a*, a second end 102*b* that is opposite from the first end 102*a*, and a sidewall 102*c* extending between the first end 102*a* and the second end 102*b* for storing the primary gases and the absorbent material. In one embodiment, the body 102 has a substantially cylindrical or frustoconical sidewall 102*c* extending between its first end 102*a* and the second end 102*b*, such as a cork or stopper shaped closure device 100, as shown in FIGS. 1A-1B. In one embodiment, the openable cap 114 is detachably attached to the first end 102*a* of the closure device 100, as shown in FIG. 1C. The openable cap 114 is configured to be removed from the body 102 allowing for the absorbent material in the chamber 102*d* to be replaced. The openable cap 114 is detachably attached to the first end 102*a* through a fit that includes at least one of a friction fit, a snap fit, a screw fit, and a pivotal fit, and thereof.

In one embodiment, the absorbent material is either a de-oxygenation agent or an oxygen scavenging agent. The absorbent material that includes at least one of metal-based substance and non-ferrous absorbent material. The absorbent material is stored in the body 102 in a form that includes a sachet, a filament, and a granular agent. In specific, the absorbent material is packed inside a gas permeable and waterproof package.

In one embodiment, the fastening member 104 is circumferentially extended around an outer surface of the body 102. In specific, the fastening member 104 is fixed on the sidewall 102*c* of the body 102. The fastening member 104 is configured to create an airtight seal for an open end of the container 10 upon insertion of the closure device 100 through the open end. In one embodiment, the fastening member 104 is a gasket made of a material that includes at least one of plastic, silicone rubber, and any flexible polymers. The fastening member 104 comprises the protrusions 106 that are extended outward radially from a surface of the fastening member 104. The protrusions 106 are engaged with an interior surface of the container 10 to ensure the airtight seal for the open end of the container 10.

In another embodiment, the fastening member 104 could have a series of snaps that would fit into corresponding grooves on the open end of the container 10. In another embodiment, the fastening member 104 would have a threaded screw that would screw into a threaded hole in the open end of a wine bottle.

In one embodiment, the blister 108 is positioned on at one end of the body 102. The blister 108 is connected to the hollow shaft 110, and the hollow shaft 110 is secured within the body 102. In one embodiment, the hollow shaft 110 contains at least one secondary gas and is configured to penetrate the seal member 112, which is disposed at a bottom of the body 102, upon pressing of the blister 108. Further, the hollow shaft 110 is configured with a puncturing member 110*a* to puncture the seal member 112 and releasing the primary and secondary gases and into the container 10. Due to the penetration action, the primary gases from the chamber 102*d* and the secondary gas from the hollow shaft 110 are released into the container 10 through at least one perforation 116 to form the protective barrier against oxidation within the container 10, and expose the absorbent material for absorbing oxygen from a headspace of the container 10.

In one embodiment, the blister 108 is configured with an indicator unit 120 indicating the presence of oxygen with the container 10, as shown in FIG. 1C. The indicator unit 120 includes at least one of a display with an oxygen sensor, and an oxygen indicator dye to measure oxygen levels present within a headspace of the container 10.

In one embodiment, the indicator unit 120 is placed inside the blister 108, and is configured to detect the presence of oxygen up to 0.01%.

In another embodiment, the absorbent material can be used to remove oxygen from the headspace of the container 10 through a chemical reaction. Metal-based absorbers, such as iron powder and sodium chloride, remove oxygen by reacting with the oxygen to form metal oxides. Other metal absorbers include elemental iron, iron oxide, iron hydroxide, iron carbide, nickel, tin, copper, and zinc. Metal absorbers are typically in the form of a powder to increase surface area. Other suitable absorbent materials include ascorbic acid, sodium ascorbate, catechol, phenol, activated carbon, polymeric materials incorporating a resin and a catalyst, ferrous carbonate, sodium hydrogen carbonate, and citrus or citric acid.

In one embodiment, the hollow shaft 110 is a thin elongated tube that contains the inert gas. The hollow shaft 110 is connected to the blister 108 at one end and to the seal member 112 at the other end. When the blister 108 is depressed, the hollow shaft 110 is forced into the seal member 112, puncturing the seal member 112 and releasing the inert gas into the container 10.

In one embodiment, the seal member 112 is disposed at a bottom of the body 102. The seal member 112 is configured to be broken by the hollow shaft 110 through the blister 108 for releasing the primary gases, and the secondary gas from the body 102 and the hollow shaft 110 into the container 10 to form the protective barrier and expose the absorbent material to the headspace of the container 10.

In one embodiment, the hollow shaft 110 is configured with one or more perforations 116 at the upper portion to facilitate unrestricted movement of oxygen into the body 102, as shown in FIG. 1C. The perforations 116 of the hollow shaft 110 are configured to allow oxygen to flow into the body 102 from the container 10 once the seal member 112 is broken.

In one embodiment, the seal member 112 is a thin piece of material that is disposed at the bottom of the body 102. The seal member 112 is responsible for preventing the inert gas from escaping from the body 102. The seal member 112 can be made of a variety of materials that include, but not limited to, rubber, silicone, metal foil, paper, and polymer thereof.

In another embodiment, the seal member 112 is detachably attached to the second end 102*b* of the body 102 through an attachment assembly. In another embodiment herein, the attachment assembly includes an adhesive. The seal member 112 is connected to the second end 102*b* of the body 102 using the adhesive. Once, the seal member 112 is broken, the broken scale member 112 is manually separated from the body 102, and a new seal member 112 attached to the body 102 using the adhesive.

In another embodiment, the seal member 112 comprises at least one connector. The connector is configured to detachably connect the seal member 112 with the second end 102*b* of the body 102. In some embodiments, the seal member 112 is connected to the second end 102*b* of the body 102 an attachment assembly such as, but not limited to, clips, clamps, and the like.

In another embodiment, the closure device 100 is inserted into the container 10, with the bottom of the body 102 exposed to the headspace of the container 10. The inert gases are released into the container 10, by breaking the seal member 112 forming the protective barrier within the container 10. The absorbent material chemically reacts with oxygen to remove it from the headspace of the container 10.

In one embodiment, a tip of the puncturing member 110*a* is placed on the seal member 112, as shown in FIG. 1C. The blister 108 is depressed to push the hollow shaft 110 into the seal member 112 for puncturing the seal member 112 and releasing the inert gas into the container 10. The seal member 112 can be made of a variety of materials that include, but not limited to, rubber, silicone, metal foil, paper, and polymer thereof. Therefore, the breaking action may also depend of the type of materials used to make the seal member 112.

In another embodiment, the blister 108 is a rotatable knob that is connected to the openable cap 114 through a plurality of threads. To puncture the seal member 112 and release the inert gas into the container 10, the blister 108 is rotated to move the hollow shaft 110 rotatably in downward direction. In another embodiment, the blister 108 is firmly attached to the openable cap 114 through a series of threads, establishing a secure and rotational connection. As the blister 108 is turned clockwise, it causes the hollow shaft 110 to move downward in a controlled manner, enabling the puncturing member 110*a* to penetrate the seal member 112 and create a larger hole in the seal member 112.

Once the puncturing member 110*a* has successfully pierced the seal member 112, the inert gases stored within the body 102 and the hollow shaft 110 is released into the container 10. The downward movement of the hollow shaft 110 creates a direct pathway for the inert gases to flow from the body 102 and the hollow shaft 110 into the container 10, effectively displacing any remaining oxygen and establishing an inert atmosphere. In one embodiment, the hollow shaft 110 is configured with the perforations 116 for allowing oxygen to flow into the body 102 from the container 10 once the seal member 112 is broken.

In another embodiment, the puncturing member 110*a* is placed under the seal member 112 and use a leverage of the hollow shaft 110 to lift the seal member 112 up and away from the second end 102*b*. In order to lift the seal member 112 up and away from the second end 102*b*, the puncturing member 110*a* is placed under the seal member 112. A downward pressure is applied to the hollow shaft 110 through the blister 108. This downward pressure causes the puncturing member 110*a* to pry the seal member 112 up and away from the second end 102*b*. The leverage of the hollow shaft 110 is used to amplify the force applied to the puncturing member 110*a*. The lifting of the seal member 112 creates a gap between the seal member 112 and the second end 102*b*. This gap allows the inert gases to flow from the hollow shaft 110 into the container 10.

In some embodiments, pressing down on the blister 108 will push the hollow shaft 110 against the seal member 112 and remove it from the body 102. This allows the primary and secondary gases to escape into container 10, and creates a path for oxygen to escape from the container 10. Alternatively, a rupturable seal may also be used in this embodiment.

In some embodiments, the blister 108 is an electric switch that is electrically coupled to the puncturing member 110*a* and a battery unit. The puncturing member 110*a* is a heating element that is in contact with the seal member 112. When the blister 108 is pressed, it activates the battery unit and heats the puncturing member 110*a*. This causes the puncturing member 110*a* to burn a hole in the seal member 112 as it comes into contact with it. The heat generated by the puncturing member 110*a* is very small but is sufficient to break the seal member 112 without causing any damage to the contents inside the container 10.

In one embodiment, the body 102, the blister 108, and the hollow shaft 110 are made of a material that includes at least one of plastic, silicone rubber, metal, natural cork, and synthetic cork. Further, the body 102, the blister 108, and the hollow shaft 110 are made of plastic that includes at least one of polyethylene terephthalate (PET), high-density polyethylene (HDPE), thermoplastic elastomer (TPE), polypropylene (PP), ethylene vinyl alcohol copolymer (EVOH), and polyamide (PA).

In one embodiment, the closure device 100 uses inert gases, such as primary and secondary gases, which are heavier than the oxygen, as the density of oxygen is 1.331 $kg/m^3$. The inert gases include at least one of argon gas, which has a density of 1.661 $kg/m^3$, krypton gas, which has a density of 3.74 $kg/m^3$, xenon gas, which has a density of 5.86 $kg/m^3$, radon gas, which has a density of 9.73 $kg/m^3$ and carbon dioxide gas, which has a density of 1.842 $kg/m^3$. In a preferred embodiment, the primary gases comprise argon gas and the secondary gas is carbon dioxide. In one embodiment, the primary and secondary gases are all over the body 102 and the hollow shaft 110.

In some embodiments, the most common food-safe absorbent material is an iron powder with sodium chloride. It works by chemically reacting with oxygen to remove it from food packaging. In specific, the absorbent material is packed inside a gas permeable and waterproof package. The moisture in the air starts to seep into the iron particles of the absorbent material once the seal member 112 is broken. In some embodiments, the absorbent material removes almost all of the unwanted oxygen from the headspace of the container 10 sealed by the closure device 100 in a short time. This prevents the oxygen from damaging the substance inside. This method selectively removes oxygen, which prevents the food or liquid from oxidative degradation. This is different from vacuum sealing a wine bottle, which reduces the partial pressure in the container 10 by a relatively small amount.

In another embodiment, the closure device 100 consists of the hollow shaft 110 that is present in an enclosed space of the container 10. The closure device 100 prevents material wastage, ensures maximum effectiveness, and avoids cross-contamination. The closure device 100 has a double action preservation system. The closure device 100 uses inert gases to protect the exposed surface of oxygen-sensitive materials and different types of oxygen scavengers to remove oxygen within flexible timeframes. The closure device 100 also has an oxygen presence indicator that informs users about the effectiveness of the product before using the product.

In some embodiment, the closure device 100 can be designed in various shapes and sizes, depending on the shape and size of a nozzle of the container 10. The closure device 100 is capable for safeguarding any oxygen-sensitive food and beverage items, such as wine, milk, pizza dough, meatloaf, and curries thereof. The closure device 100 releases gases and elements to activate chemical reactions or to protect elements from chemical reactions in an enclosed environment.

In some embodiments, the closure device 100 utilizes a minimal amount of inert gases and restricts the utilization of ferrous oxygen absorbent that can impart undesirable metallic or "rusty" aromas and flavors and rendering the wine "reductive". This aids to prevent negative pressure build-up inside the container 10, which can lead to displacement of vital volatile aromatics. The closure device 100 uses inert gases to protect wine and other oxygen-sensitive products from oxidation without competing with the absorbent material to consume oxygen in the headspace of the container 10.

FIGS. 2A-2D refer to perspective views of the openable cap 114, and the body 102 that defines the channel or the chamber 102*d* of the closure device 100. The closure device 100 has the openable cap 114 that attaches to the first end 102*a* of the closure device 100. The openable cap 114 comprises the blister 108 and the hollow shaft 110. The openable cap 114 can be square, rectangular, circular, triangular, or any other shape that matches the cross-sectional shape of the closure device 100. The openable cap 114 can be attached to the closure device 100 by snapping it on, pushing it on, or screwing it on.

Figure 2A:
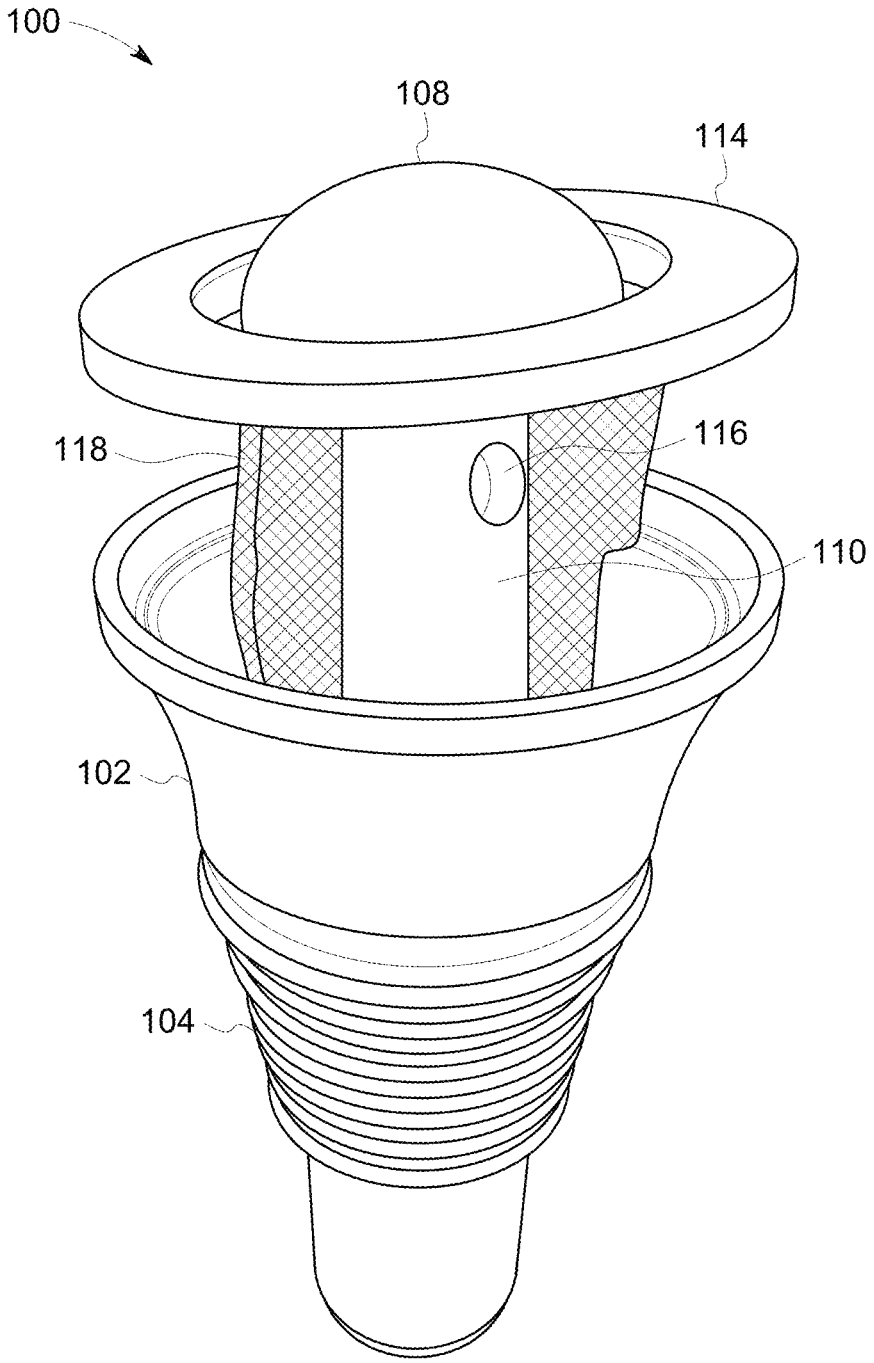
FIG. 2A illustrates a perspective view of an opened closure device, in accordance with embodiments of the invention.

The openable cap 114 can be removed to replace the used absorbent material 118 with new absorbent material. This is important because the absorbent material 118 will eventually become saturated and will no longer be effective at removing oxygen. The upper portion of the hollow shaft 110 is configured with the perforations 116 that facilitate unrestricted movement of oxygen into the body 102, where the absorbent material 118 are housed within a packaging unit, as shown in FIG. 2A. The perforations 116 allow oxygen to flow into the body 102 from the container 10. This is important because the absorbent material 118 needs oxygen to function properly.

Figure 2B:
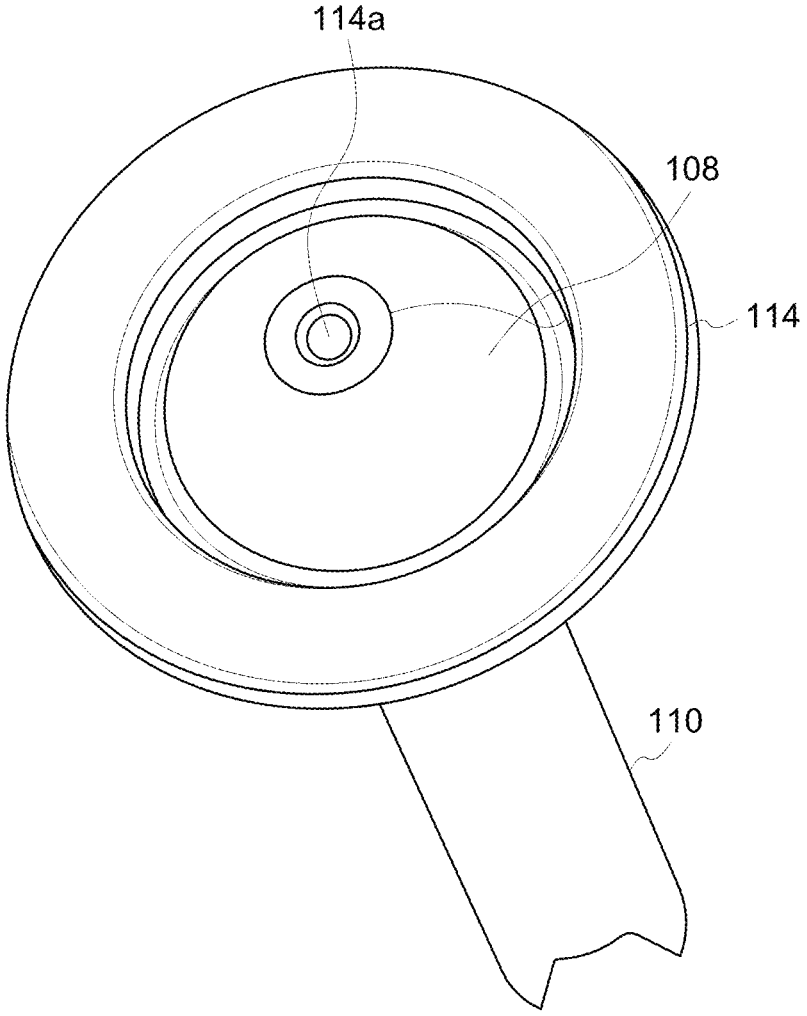
FIG. 2B illustrates a perspective top view of an openable cap with a blister that is attached with a hollow shaft of the closure device, in accordance with embodiments of the invention.

The openable cap 114 includes a one way valve 114*a* at the top to inject the inert gases into the body 102, as shown in FIG. 2B. The one way valve 114*a* is configured to allow the inert gases to be injected into the body 102. In one embodiment, the one way valve 114*a* aids to displace any oxygen that is already in the body 102. Further, the one way valve 114*a* creates a positive pressure inside the body 102, which aids to prevent oxygen from entering the body 102.

Figure 2C:
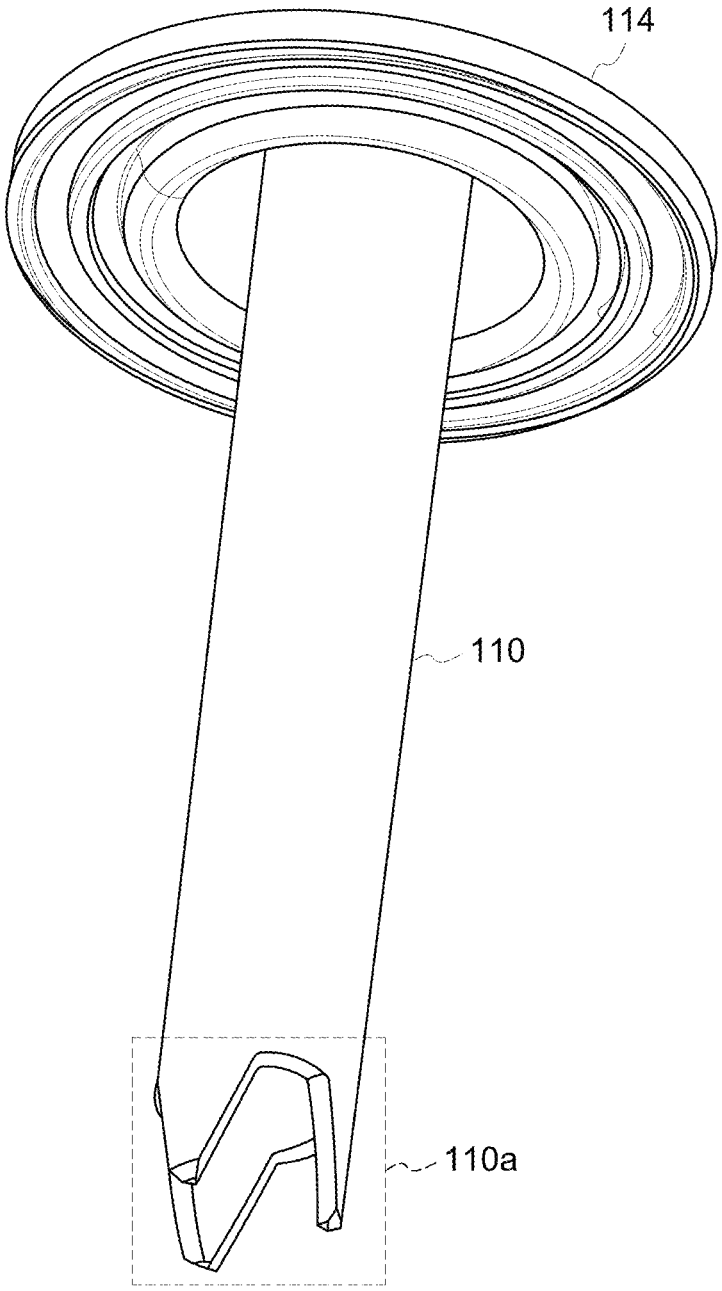
FIG. 2C illustrates a perspective bottom view of the hollow shaft of the closure device, in accordance with embodiments of the invention.
Figure 2D:
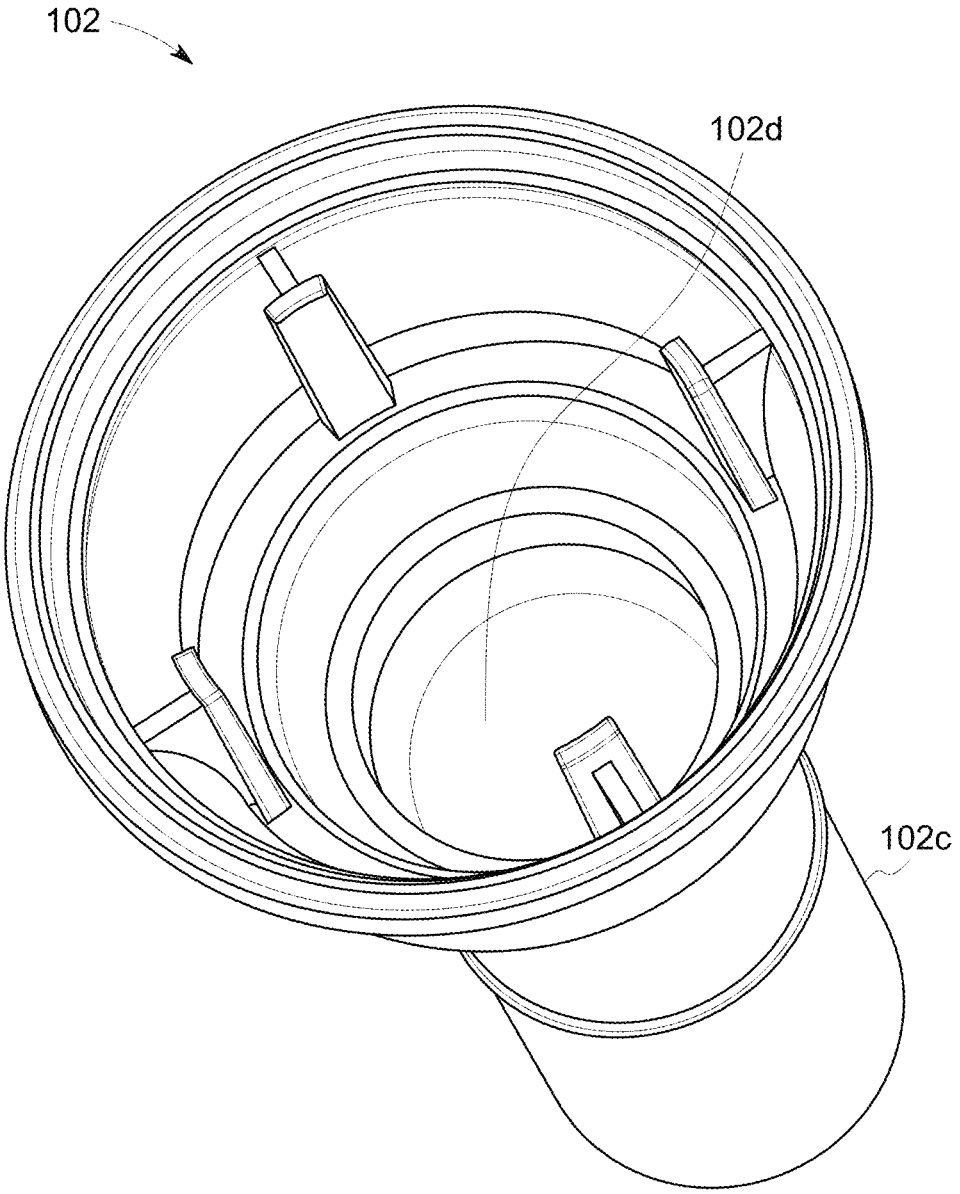
FIG. 2D illustrates a perspective view of uncovered body of the closure device, in accordance with embodiments of the invention.

Referring to FIG. 2C, the hollow shaft 110 is configured with the puncturing member 110*a*. The puncturing member 110*a* is configured to puncture the seal member 112 and releasing the inert gas into the container 10.

Figure 2E:
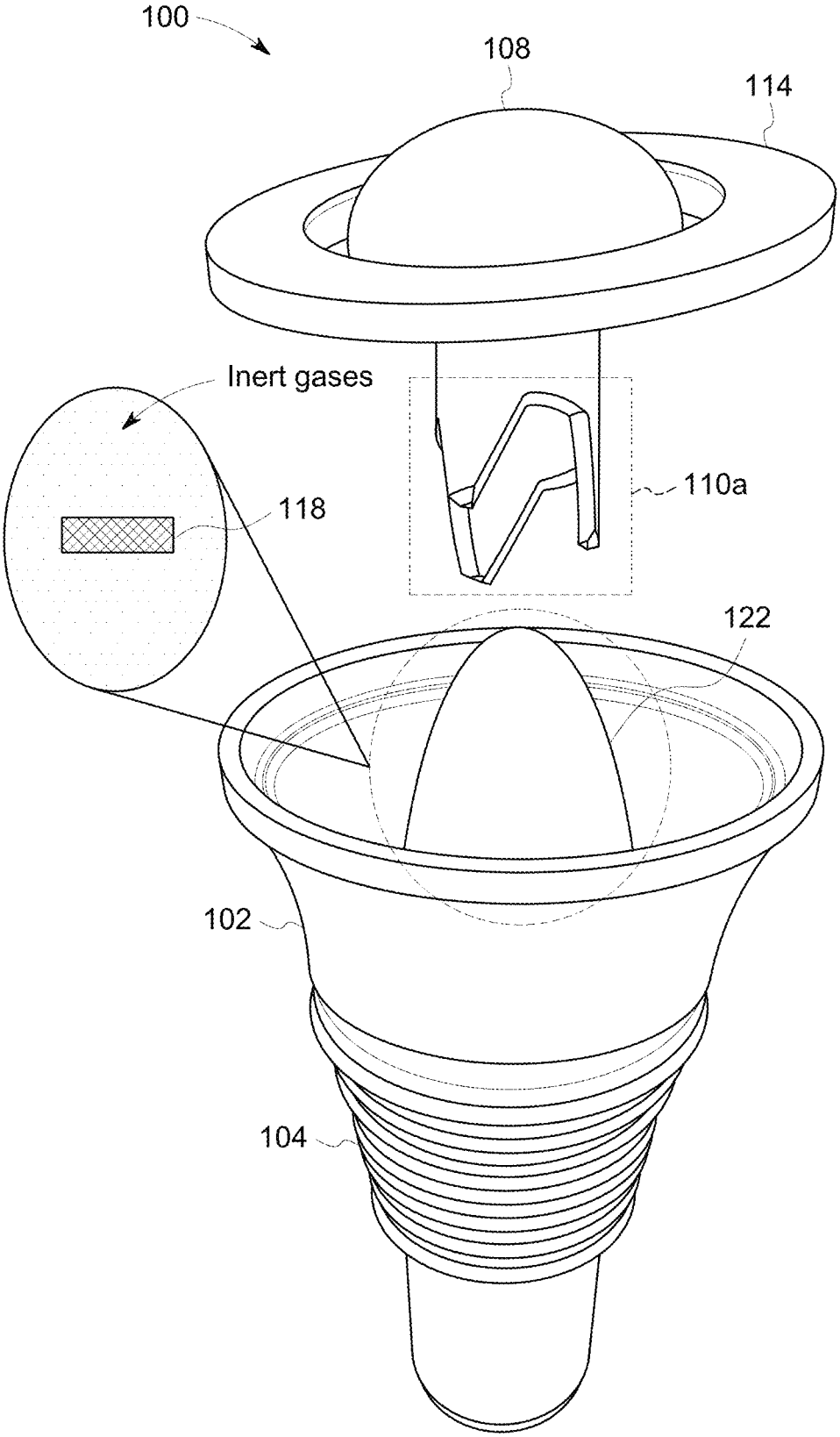
FIG. 2E illustrates a perspective view of the closure device with a replaceable capsule, in accordance with embodiments of the invention.

FIG. 2E refers to another embodiment the closure device 100. In another embodiment herein, the closure device 100 comprises a replaceable capsule 122. In one embodiment herein, the replaceable capsule 122 contains the absorbent material 118, and filled with the inert gases. The blister 108 is firmly attached to the openable cap 114. The blister 108 is connected with the puncturing member 110*a*. In specific, the absorbent material 118 is enclosed entirely within the replaceable capsule 122. When the blister 108 is pressed down, the puncturing member 110*a* punctures the replaceable capsule 122. This action leads to the release of the inert gases, which creates the protective barrier against oxygen, within the headspace of the container 10. At the same time, the absorbent material 118 inside the replaceable capsule 122 is exposed within the headspace of the container 10, which further removes any residual oxygen within the container 10, ensuring that the contents remain fresh and unaffected by any harmful environmental factors.

In another embodiment, the puncturing member 110*a* is fixedly attached to the blister 108 of the openable cap 114, wherein the puncturing member 110*a* is secured within the body 102, as shown in FIG. 2E. The puncturing member 110*a* moves downwards when the blister 108 is pressed down, thereby piercing the top of the replaceable capsule 122. As the replaceable capsule 122 is punctured, the inert gases are released, thereby forming a protective barrier within the headspace of the container 10, and simultaneously the absorbent material is exposed in the headspace of the container 10. The absorbent material absorbs the remaining oxygen from the headspace of the container 10.

In another embodiment, the puncturing member 110*a* is attached within the chamber 102*d*. When the blister 108 pressed down, the blister 108 applies force to a lever within the closure device 100. The blister 108 pushes down on the lever, which transmits the force to the puncturing member 110*a* that punctures the replaceable capsule 122. In some embodiments, the puncturing member 110*a* is either a needle or a blade or a sharp edge.

When the absorbent material 118 becomes saturated and will no longer be effective at removing oxygen. The openable cap 114 is removed to replace the punctured replaceable capsule 122 with a new replaceable capsule. Thereby, the closure device 100 is reused, requiring only the replaceable capsule 122 to be replaced after each use.

In some embodiments, specific design of the puncturing mechanism and the replaceable capsule 122 depend on factors like the size and shape of the container 10 and the closure device 100, the desired activation force, and the targeted application. In some embodiments, the replaceable capsule 122 is a replaceable balloon capsule or inert gas bag made of thin film of single or multi layers of plastic that includes, but not limited to, polyethylene terephthalate (PET), high-density polyethylene (HDPE), Low-Density polyethylene (LDPE), thermoplastic elastomer (TPE), polypropylene (PP), ethylene vinyl alcohol copolymer (EVOH), and polyamide (PA).

In another embodiment, the replaceable capsule 122 contains both the inert gas and the absorbent material i.e., oxygen scavengers that can be inserted through the openable cap 114 of the closure device 100. The replaceable capsule 122 replaces the need to use the one way valve 114*a* to inject the inert gases into the body 102. When the blister 108 is pushed down the replaceable capsule 122 is punctured a sharp object located at the top, bottom, or side of the body 102. This allows the inert gases and oxygen scavengers to be released into the body 102, creating a safe environment for the contents of the container 10.

In another embodiment, the replaceable capsule 122 in the closure device 100 is a small container filled with an inert gas that is designed to protect the oxygen scavengers from being exposed to oxygen. This ensures that the closure device 100 remains effective and has not expired. The replaceable capsule 122 is not only effective, but also environmentally friendly, allowing the closure device 100 to be reused and recycled.

To replace the punctured replaceable capsule 122, simply open the openable cap 114 and remove the punctured replaceable capsule 122 from the closure device 100. Thereby a new replaceable capsule is inserted into the closure device 100 and thereafter the openable cap 114 is closed. The replaceable capsule 122 is incredibly lightweight and compact, making it easy and economical to ship separately to different markets. Moreover, the replaceable capsule 122 can be inflated with inert gas in different markets on demand, further reducing transportation costs.

An inflated replaceable capsule 122 also serves as an indicator for effectiveness of the closure device 100. Once it has been punctured, the replaceable capsule 122 gradually deflates, which signals that the closure device 100 may no longer be effective. Therefore, it is important to replace the punctured replaceable capsule 122 with a new one after each use to ensure the closure device 100 remains effective.

In another embodiment, the hollow shaft 110 serves as a conduit for the inert gas to enter the container 10. The puncturing member 110*a* is configured to pierces through the seal member 112 when the blister 108 is pressed, allowing the inert gases to flow freely into the container 10. The puncturing member 110*a* is typically a sharp, pointed protrusion integrated at bottom of the hollow shaft 110. The puncturing member 110*a* is design to penetrate the scale member 112. Once the seal member 112 is punctured, the inert gases are able to flow through the hollow shaft 110 and into the container 10, effectively displacing any remaining oxygen and creating an inert atmosphere.

In another embodiment, the hollow shaft 110 is configured with different types of puncturing member 110*a* that includes, but not limited to, a needle-type puncturing member, or a slit-type puncturing member, or a saw-tooth puncturing member or the likes. In another embodiment, the needle-type puncturing member has a sharp, pointed tip that is similar to a needle. The needle-type puncturing member is often used to puncture thin, pliable materials such as plastic films. In another embodiment, the slit-type puncturing member has a sharp, blade-like edge that is used to make a slit in the seal member 112. The slit-type puncturing member is often used to puncture thick, rigid materials such as metal cans. In another embodiment, the saw-tooth puncturing member has a series of sharp teeth that are used to make a serrated hole in the seal member. The saw-tooth puncturing member is often used to puncture materials that are difficult to puncture with other types of puncturing members, such as multi-layered films.

FIG. 3 refers to a perspective view of the closure device 100 inserted into the open end of the container 10. The absorbent material 118 is secured by the closure device 100. For instance, the container 10 can store any oxygen-sensitive substances, such as wine with vital volatile aromatics. The blister 108 is pressed by a user to push the hollow shaft 110 downward, thereby penetrating the seal member 112. As a result, the primary gases from the body 102 and the secondary gas from the hollow shaft 110 are released into the headspace of the container 10, thereby forming the protective barrier within the headspace of the container 10. Since, the primary and secondary gases are heavier than the oxygen. Oxygen is pushed upward, toward the absorbent material 118 of the closure device 100, as the primary and secondary gases flow downward into the container 10. The oxygen is absorbed and removed from the container 10 by the absorbent material 118.

Figure 4:
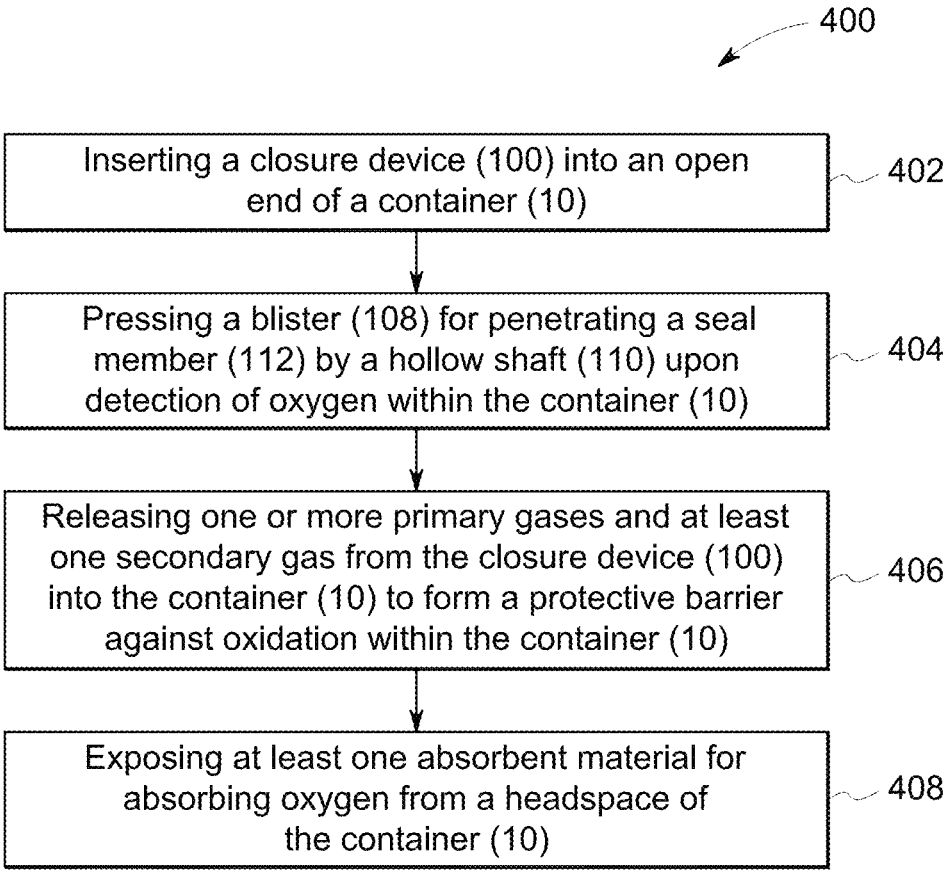
FIG. 4 illustrates a flowchart depicting a method for de-oxygenation of the container by the closure device, in accordance with embodiments of the invention.

FIG. 4 refers to a flowchart 400 depicting a method for de-oxygenation of the container 10 by the closure device 100. At step 402, the closure device 100 is inserted into the open end of the container 10 by inserting the body 102 into the open end of the container 10, as shown in FIG. 3. At step 404, the blister 108 is pressed to push the hollow shaft 110 in a downward direction to penetrate the seal member 112 by the hollow shaft 110. In specific, the indicator unit 120 monitors oxygen levels with a sensitivity of up to 0.01%. Upon detecting oxygen levels exceeding a predetermined threshold of 0.01%, the indicator unit 120 alerts the user through visual or audible means.

At step 406, as the seal member 112 is broken, the primary gases from the body 102, and the secondary gas from the hollow shaft 110 are released into the headspace of the container 10 to form the protective barrier within the container 10. At step 408, the absorbent material is exposed within the headspace for absorbing oxygen from the container 10.

Figure 5A:
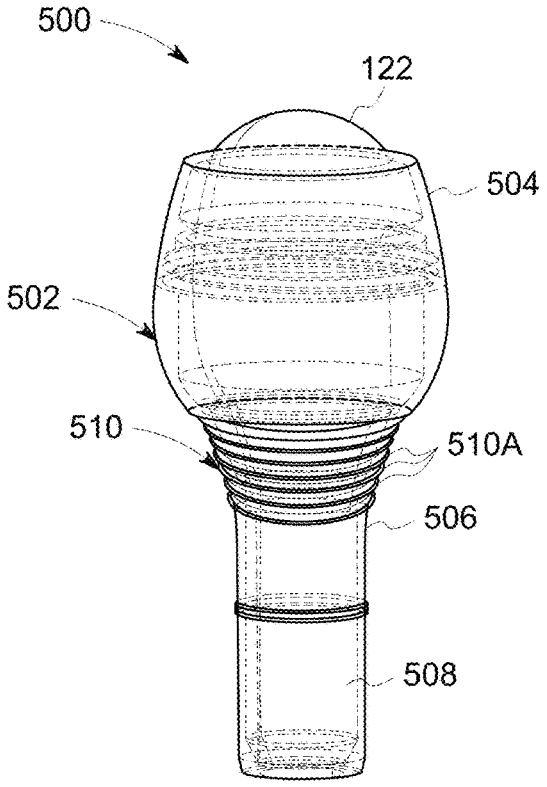
FIGS. 5A-5F refer to the closure device, in accordance with another embodiment of the invention.
Figure 5B:
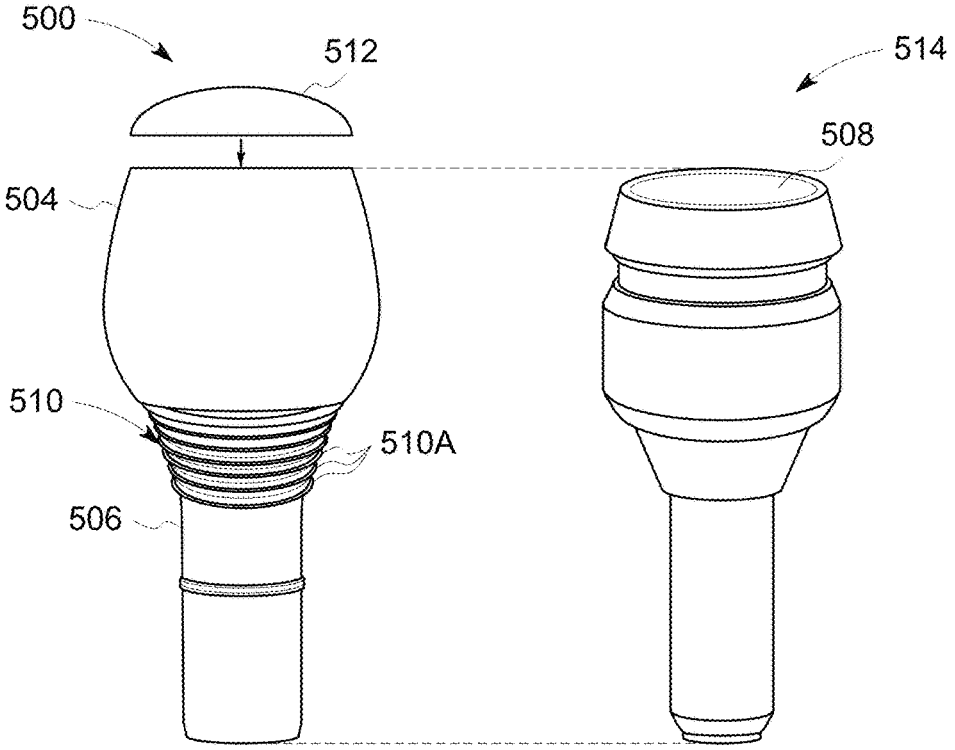
Figure 5C:
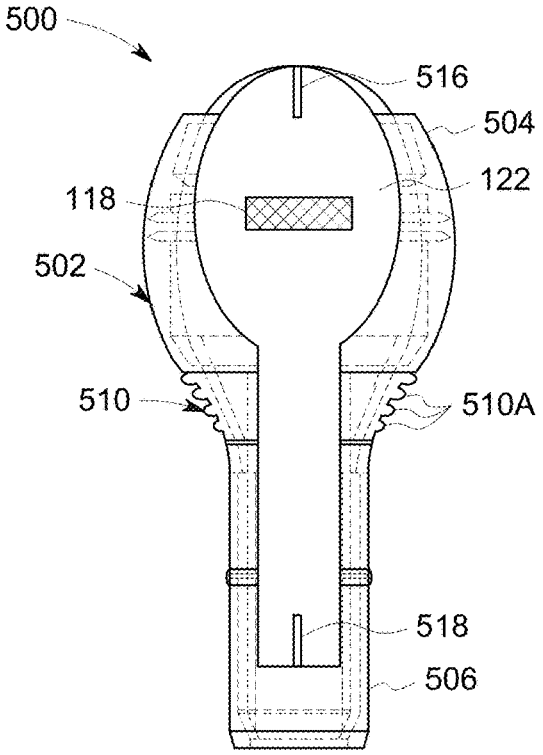
Figure 5D:
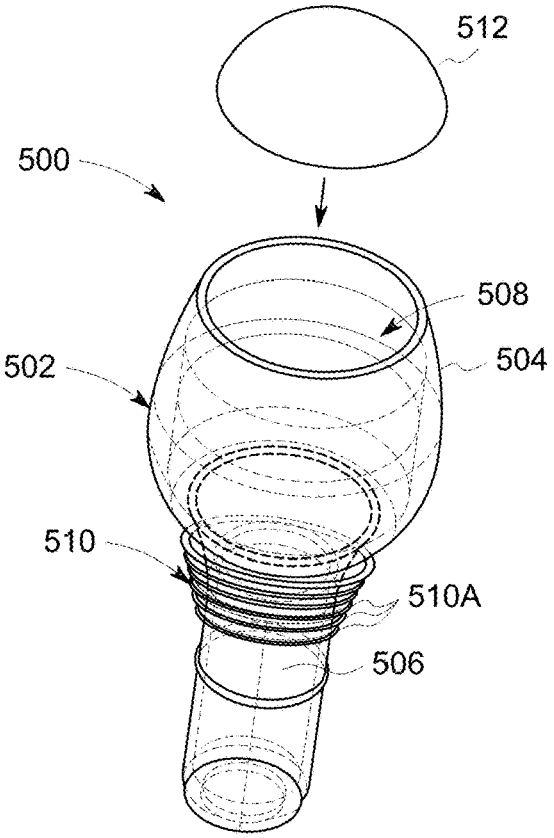
Figure 5E:
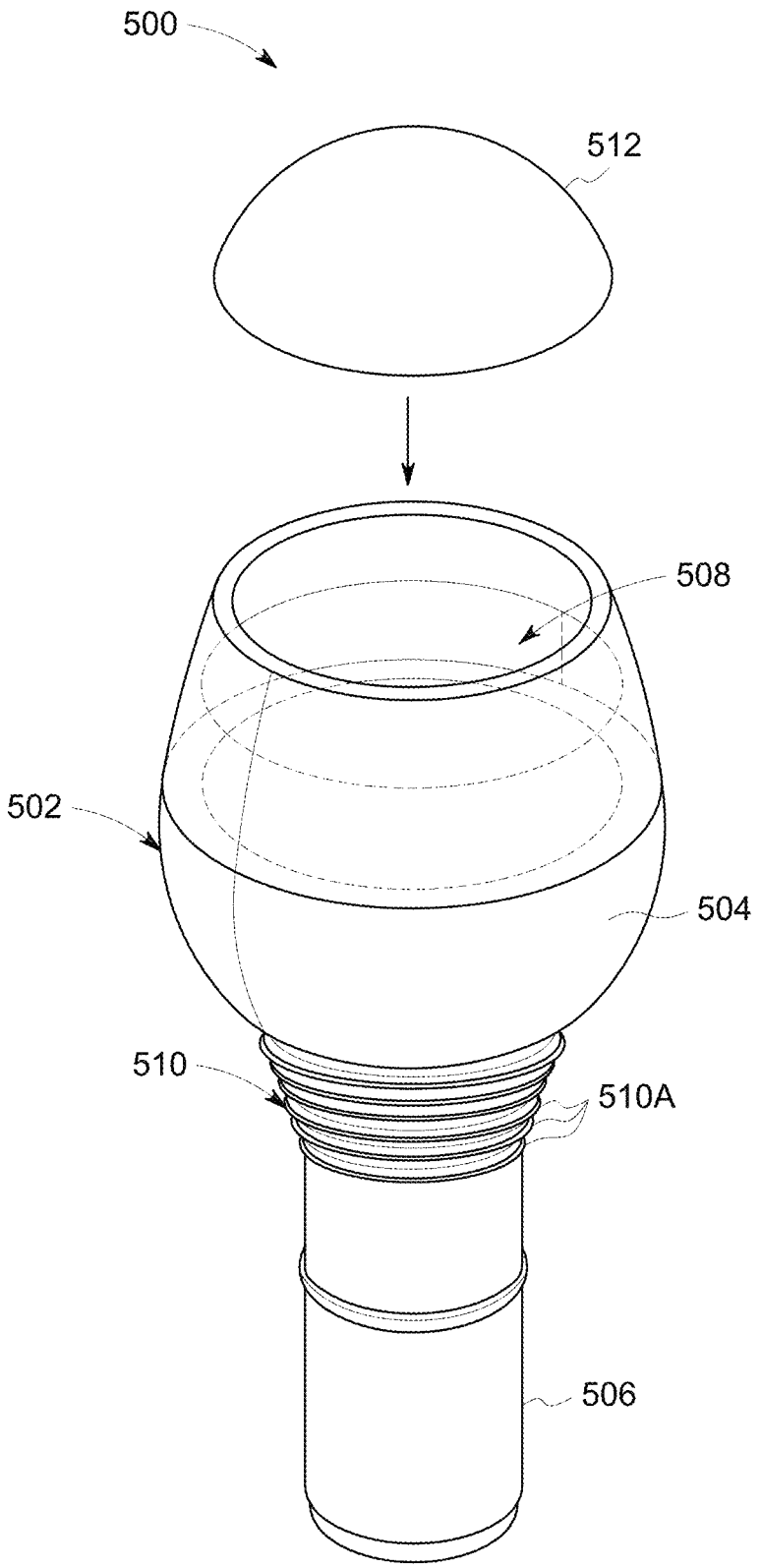

FIGS. 5A-5F refers to the closure device 500 in another embodiment of the present invention. In one embodiment herein, the closure device 500 comprises a body 502 with an openable head 504, and an elongated cylindrical portion 506 that is connected to the openable head 504. The body 502 defines a chamber 508 that is configured for securing the replaceable capsule 122. The replaceable capsule 122 is configured for holding the inert gases and the oxygen absorbing agent. In another embodiment, the elongated cylindrical portion 506 comprises an open end that is exposed within the headspace of the container. The closure device 500 comprises a blister 512 as shown in FIGS. 5B, 5D and 5E.

In one embodiment, the body 502 comprises an inner structure 514 that contoured to match a shape of the body 502, as shown in FIG. 5B. In one embodiment, the openable head 504 is in a spherical shape. The openable head 504 is detachably attached to the elongated cylindrical portion 506 through a fitting mechanism that includes at least one of a friction fit, a snap fit, a screw fit, and a pivotal fit thereof. In one embodiment, the fitting mechanism is located over the inner structure 514 of the body 502 and ensures a secure and stable attachment.

Figure 5F:
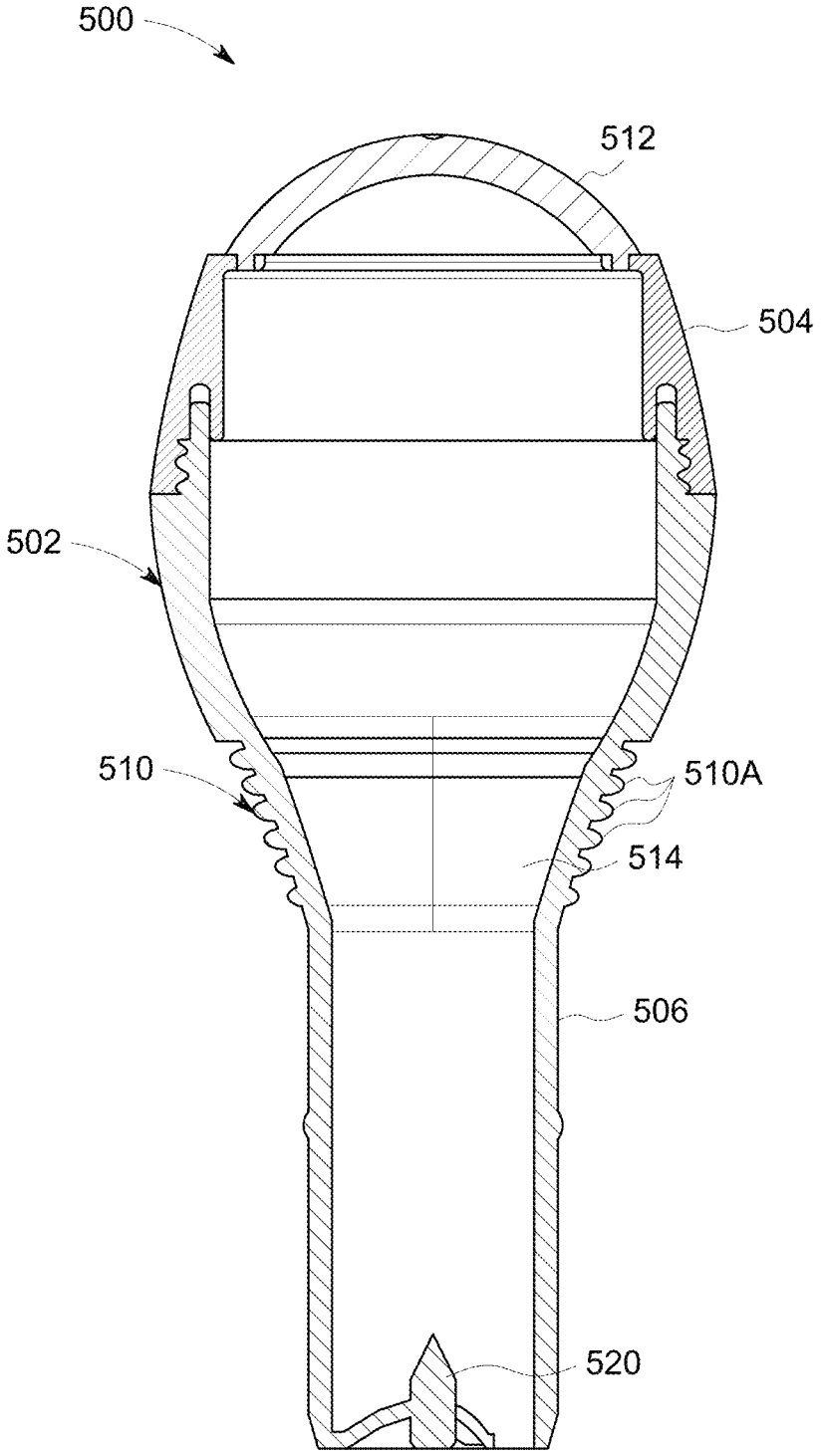

The blister 512 is configured to be pressed by the user to puncture the replaceable capsule 122. In one embodiment, the blister 512 is connected to the puncturing member 520. In some embodiments, the puncturing member 520 is connected to the blister 512 through a lever mechanism. The puncturing member 520 is designed to pierce the replaceable capsule 122, thereby releasing the inert gases, as shown in FIG. 5F. When the blister 512 is pressed down, it applies force to a lever within the closure device 500. This lever transmits the force to the puncturing member 520, thereby causing it to puncture the replaceable capsule 122. When the blister 512 is pushed down, it exerts force on the lever, which amplifies the force and transmits it to the puncturing member 520. This ensures that the replaceable capsule 122 is pierced with sufficient force to release the inert gases.

In another embodiment, the openable head 504 is connected to top portion of the body 502 through a plurality of threads, as shown in FIG. 5F. To puncture the replaceable capsule 122 for releasing the inert gas into the container 10, the blister 512 is pressed down to move the puncturing member 520 in downward direction. Due to the downward motion, the puncturing member 520 punctures the replaceable capsule 122. This action leads to the release of the inert gases from the replaceable capsule 122, which creates the protective barrier against oxygen, within the headspace of the container 10. At the same time, the absorbent material 118 inside the replaceable capsule 122 is exposed due to punching of the replaceable capsule 122, further removing any residual oxygen within the container 10.

In some embodiments, the openable head 504 is turned one direction causing the puncturing member 520, which is connected to the blister 512, to move downward in a controlled manner, thereby allowing the puncturing member 520 to puncture the replaceable capsule 122. This action leads to the release of the inert gases from the replaceable capsule 122, which creates the protective barrier against oxygen, within the headspace of the container 10. At the same time, the absorbent material 118 inside the replaceable capsule 122 is exposed, further removing any residual oxygen within the container 10.

In another embodiments, the puncturing member 520 comprises, but is not limited to, is either a needle or a blade or a sharp-edged portion.

In another embodiment, the blister 512 connected to the puncturing member 520, as shown in FIG. 5B. In specific, the absorbent material 118 is enclosed entirely within the replaceable capsule 122. When the blister 512 is pressed down, the puncturing member 520 punctures the replaceable capsule 122. At the same time, the absorbent material 118 inside the replaceable capsule 122 is exposed, further removing any residual oxygen within the container 10, thereby ensuring that the contents remain fresh and unaffected by any harmful environmental factors.

After the replaceable capsule 122 is punctured, it gradually deflates, which indicates that the closure device 500 may no longer be effective. To ensure the closure device 500 remains effective, it is crucial to replace the punctured replaceable capsule 122 with a new one after each use.

In one embodiment herein, the closure device 500 ensures the airtight seal when disposed on the container 10 to preserve liquids and other items, which degrade when exposed to oxygen for a period of time through a protective barrier and at least one absorbent material 118 against oxidation. In one embodiment herein, the closure device 500 could be used multiple times by replacing the replaceable capsule 122 with new one after each use.

Referring to FIG. 5C, the replaceable capsule 122 is equipped with two valves for regulating the flow of inert gas. At the top end of the replaceable capsule 122, there is a first valve 516 which controls the flow of inert gas into the replaceable capsule 122. At the bottom end, a second valve 518 regulates the outflow of inert gas from the replaceable capsule 122. In specific, the first valve 516 is configured to inject the inert gases into the replaceable capsule 122.

When the blister 512 is pressed down, the puncturing member 520 pierces or enters the first valve 516 and then passes through the second valve 518, thereby opening the first valve 516 and the second valve 518. This action deflates the replaceable capsule 122, releasing inert gases that create a protective barrier against oxygen within the headspace of the container 10. At the same time, the absorbent material 118 inside the replaceable capsule 122 is exposed, further removing any residual oxygen within the container 10, thereby ensuring that the contents remain fresh and unaffected by any harmful environmental factors.

In one embodiment herein, the closure device 500 is removably coupled to an open end of the container 10 through a fastening member 510. The fastening member 510 is circumferentially extended around an outer surface of the body 502. In one embodiment herein, the fastening member 510 is configured to create an airtight seal for an open end of the container 10 upon insertion of the closure device 500 through the open end. In one embodiment, the fastening member 510 is a gasket made of a material that includes at least one of plastic, silicone rubber, and any flexible polymers. The fastening member 510 comprises the protrusions 510A that are extended outward radially from a surface of the fastening member 510. The protrusions 510A are engaged with an interior surface of the container 10 to ensure the airtight seal for the open end of the container 10, as shown in FIGS. 5A-5F.

In another embodiment, the fastening member 510 includes at least one of a friction fit, a snap fit, or any of a variety of fastening mechanisms.

In some embodiments, the closure device (100, 500) provides combined protection of inert gas and oxygen scavenger methods. This means that it uses both inert gas and absorbent materials to protect the wine from oxygen exposure. The closure device (100, 500) utilizes a less aggressive de-oxygenation agent than aggressive oxygenation agent such as ferrous/metal scavenger only, which can create a partial vacuum within the headspace when oxygen is removed. This partial vacuum can displace the volatile aromatics inside the wine or juice creating a muted profile.

In some embodiments, the closure device (100, 500) uses less aggressive agent that replaces oxygen with carbon dioxide, which is another inert gas thus no vacuum is created within the headspace some non-ferrous oxygen scavengers such as ascorbic acid are known to have strong antioxidant capacity resulting in fruitier and fresher aromas and flavors of wines.

In some embodiment, the closure device (100, 500) is specifically tailored for vessels like wine bottles. It is designed to fit snugly over the neck of the bottle and create a tight seal. This prevents oxygen from leaking into the bottle and degrading the wine. Further, the closure device (100, 500) is a convenient and effective way to preserve opened wine. The closure device (100, 500) uses a combination of inert gas and oxygen scavenger methods to protect the wine from oxygen exposure and preserve its quality and flavor.

In some embodiments, the closure device (100, 500) is specifically tailored for wine bottles, which extends the shelf life of an opened wine bottle. The closure device (100, 500) protects wine from oxygen exposure and preserves the fruitier and fresher aromas and flavors of wine.

In some embodiment, inert gas covers the exposed wine surface. This prevents oxygen from coming into contact with the wine, which causes oxidation. Inert gases such as argon are colorless, odorless, and tasteless, so they do not affect the flavor of the wine. The absorbent material removes oxygen within the headspace of the container 10. The headspace is the empty space between the wine and the closure device (100, 500). The absorbent material removes oxygen from the headspace of the container 10, further preventing oxidation. In case, the absorbent material is a non-ferrous absorbent material such as, but not limited to, ascorbic acid. Then, the non-ferrous absorbent material reacts with oxygen and absorbs oxygen from the container 10 to release carbon dioxide which functions as the secondary inert gas to form the protective barrier in the container 10.

Further, the closure device (100, 500) provides non-invasive double action preservation systems, which do not displace volatile aromatics of the product, for example, wine out of the container 10 and thereby preserves the product's scents, flavors, and taste. Furthermore, the closure device (100, 500) is designed for single use, which limits the potential for cross-contamination and improper use. The closure device (100, 500) is a convenient and effective way to preserve wine for weeks after opening.

In some embodiments, the closure device (100, 500) could increase wine sales for food and beverages (F&B) services in a few ways. The closure device (100, 500) allows restaurants to feature more wines by the glass. This is because customers are more likely to order a glass of wine if they know that the unfinished bottle can be preserved for later consumption. This allows restaurants to offer a wider variety of wines to their customers, which can lead to increased sales. Further, the closure device (100, 500) could encourage customers to order multiple bottles of wine. This is because customers could finish the bottles at their own pace, without having to worry about the wine going bad. This can lead to increased sales for restaurants, especially for high-end wines. The closure device (100, 500) could improve the customer experience. Customers appreciate the ability to enjoy the same bottle of wine over multiple visits. This can lead to increased customer satisfaction and loyalty.

In some embodiments, the closure device (100, 500) is a cost-effective way for wine educators, sommeliers, and wine students to re-taste opened wines or conduct multiple blind tasting exercises by saving or sharing unfinished bottles.

In some embodiments, the closure device (100, 500) could assist wine distributors, wineries, and consumers reduce wine waste. Wine distributors and wineries could use the closure device (100, 500) to preserve opened, unfinished bottles of wine. This can aids to reduce the amount of wine wasted for wine tasting, thereby saving wine cost. Wine consumers could also benefit from the closure device (100, 500). The wine consumers can open multiple bottles of wine at a time or open a bottle just for a glass, knowing that the unfinished wine will stay fresh for a long time. This can aid the wine consumers to enjoy their wine more and to reduce waste.

In some embodiments, in food packaging, the closure device (100, 500) is used to introduce inert gas into containers holding oxygen-sensitive food items, such as fresh produce or dried goods. This helps to extend the shelf life of the food by preventing degradation caused by oxygen exposure. In pharmaceutical packaging, the closure device (100, 500) is employed to create an inert environment for medications that are susceptible to oxidation or degradation due to oxygen exposure. This ensures the preservation of the drug's efficacy and safety. In wine preservation, the closure device (100, 500) is utilized to inject inert gas into wine bottles, preventing oxidation and preserving the wine's flavor and aroma. This allows wine enthusiasts to enjoy opened bottles for extended periods. In electronic component packaging, the closure device (100, 500) is used to create an inert atmosphere around sensitive electronic components, protecting them from moisture and oxygen damage. This enhances the reliability and lifespan of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principles of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

It will readily be apparent that numerous modifications and alterations can be made to the processes described in the foregoing examples without departing from the principles underlying the invention, and all such modifications and alterations are intended to be embraced by this application.

The claimed invention is:

1. A closure device for a container, comprising:

a body defining a chamber for storing one or more primary gases and at least one absorbent material;

a fastening member circumferentially extended around an outer surface of said body, wherein said fastening member is configured to create an airtight seal for an open end of said container upon insertion of said closure device through said open end; and a blister positioned at one end of said body, wherein said blister is connected to a hollow shaft, which is disposed within said body, wherein said hollow shaft contains at least one secondary gas and is configured to penetrate a seal member disposed at a bottom of said body upon actuation of said blister, thereby releasing said one or more primary gases from said chamber and said at least one secondary gas from said hollow shaft into said container to form a protective barrier against oxidation within said container, and expose said at least one absorbent material for absorbing oxygen from a headspace of said container, whereby said closure device ensures said airtight seal when disposed on said container to preserve products such as liquids and other items, which degrade when exposed to oxygen for a period of time through said protective barrier and said at least one absorbent material against oxidation.

2. The closure device of claim 1, wherein said at least one absorbent material is a deoxygenation agent or an oxygen scavenging agent.

3. The closure device of claim 1, wherein said closure device is removably coupled to said open end of said container through a fastening assembly, wherein said fastening assembly includes at least one of a friction fit, a snap fit, a rotatable fit or screw fit, or any of a variety of fastening mechanisms.

4. The closure device of claim 1, wherein said closure device is made of a material includes at least one of plastic, silicone rubber, metal, natural cork, and synthetic cork.

5. The closure device of claim 1, wherein said closure device is made of a plastic material, which includes at least one of polyethylene terephthalate (PET), high-density polyethylene (HDPE), thermoplastic elastomer (TPE), polypropylene (PP), ethylene vinyl alcohol copolymer (EVOH), and polyamide (PA).

6. The closure device of claim 1, wherein said fastening member is made of a material that includes at least one of plastic, silicone rubber, and any flexible polymers.

7. The closure device of claim 1, wherein said fastening member comprises plurality of protrusions extended outward radially from a surface of said fastening member, wherein said plurality of protrusions is engaged with an interior surface of said container to ensure said airtight seal for said open end of said container.

8. The closure device of claim 1, wherein said hollow shaft defining a channel for storing said at least one secondary gas.

9. The closure device of claim 1, wherein said one or more primary gases and said at least one secondary gas are inert gases include at least one or a mixture of gases that are heavier than oxygen, which include at least one of argon gas, krypton gas, xenon gas, radon gas and carbon dioxide gas, wherein most preferably at least one primary gas comprise argon gas and said at least one secondary gas comprise carbon dioxide.

10. The closure device of claim 1, wherein said at least one secondary gas comprise argon gas.

11. The closure device of claim 1, wherein said at least one absorbent material includes at least one of metal-based substances and non-ferrous absorbent material, wherein said non-ferrous absorbent material absorbs oxygen within from said container to release said at least one secondary inert gas which is carbon dioxide to form said protective barrier.

12. The closure device of claim 1, wherein said closure device comprises an indicator unit for indication of the presence of oxygen in said container.

13. The closure device of claim 12, wherein said indicator unit includes at least one of a display and an oxygen indicator dye to measure oxygen levels present within said headspace of said container.

14. A closure device for a container, comprising:

a body defining a channel for storing one or more inert gases and at least one absorbent material;

a fastening member circumferentially extended around an outer surface of said body, wherein said fastening member is configured to create an airtight seal for an open end of said container upon insertion of said closure device through said open end;

a blister with an indicator unit fixedly disposed on said body;

a hollow shaft operably connected to said blister, wherein said hollow shaft is positioned within said body, and configured to contain at least one inert gas; and a seal member disposed at a bottom of said body, wherein said seal member is punctured by said hollow shaft upon actuation of said blister, thereby releasing said one or more inert gases from said channel and said at least one inert gas from said hollow shaft into said container to form a protective barrier against oxidation within said container, and expose said at least one absorbent material for absorbing oxygen from a headspace of said container;

a replaceable capsule is enclosed with said body for holding said one or more inert gases and said at least one oxygen absorbing agent, whereby said closure device ensures said airtight seal when disposed on said container to preserve liquids and other items, which degrade when exposed to oxygen for a period of time through said protective barrier and said at least one absorbent material against oxidation.

15. The closure device of claim 14, wherein said body, said blister, and said hollow shaft are made of a material that includes at least one of plastic, silicone rubber, metal, natural cork, and synthetic cork.

16. The closure device of claim 14, wherein said fastening member is made of a material that includes at least one of plastic, silicone rubber, and any flexible polymers.

17. The closure device of claim 14, wherein said fastening member comprises plurality of protrusions extended outward radially from a surface of said fastening member, wherein said plurality of protrusions is engaged with an interior surface of said container to ensure said airtight seal for said open end of said container.

18. The closure device of claim 14, wherein said replaceable capsule is punctured by said hollow shaft upon actuation of said blister, thereby releasing said one or more inert gases into said container to form said protective barrier against oxidation within said container, and expose said at least one absorbent material for absorbing oxygen from said headspace of said container, wherein said at least one absorbent material is a de-oxygenation agent or an oxygen scavenging agent.

19. A closure device for a container, comprising:

a body having an openable head and an elongated cylindrical portion detachably connected to the openable head, wherein the body is defined with a channel;

a replaceable capsule secured within the channel of the body, wherein the replaceable capsule is configured for holding one or more inert gases and at least one absorbent material; and a blister disposed on said openable head, wherein the blister is operably connected to a puncturing member positioned within said body, and wherein said puncturing member is configured to puncture said replaceable capsule upon actuation of said blister, thereby releasing said one or more inert gases into said container to form a protective barrier against oxidation within said container, and exposing said at least one absorbent material for absorbing oxygen from a headspace of said container.

20. The closure device of claim 19, wherein said puncturing member comprises at least one of a needle, a blade, or a sharp-edged portion, wherein said puncturing member is configured to puncture said replaceable capsule with force to release said one or more inert gases.

21. The closure device of claim 19, wherein said openable head is detachably attached to said body through a fit that includes at least one of a friction fit, a snap fit, a screw fit, and a pivotal fit.

22. The closure device of claim 19, wherein said replaceable capsule comprises a pair of valves including a first valve at a top end of said replaceable capsule and a second valve at a bottom end of said replaceable capsule, wherein said puncturing member is configured to open said pair of valves during puncturing, thereby regulating controlled release of said one or more inert gases from said replaceable capsule.

23. The closure device of claim 19, wherein said at least one absorbent material is a deoxygenation agent or an oxygen scavenging agent.

* * * * *